US005334063A

United States Patent [19]

Inoue et al.

[11] Patent Number: 5,334,063

[45] Date of Patent: Aug. 2, 1994

[54] COOLING SYSTEM FOR MARINE PROPULSION ENGINE

[75] Inventors: Seiji Inoue; Masayoshi Nanami, both of Hamamatsu, Japan

[73] Assignee: Sanshin Kogyo Kabushiki Kaisha, Hamamatsu, Japan

[21] Appl. No.: 42,124

[22] Filed: Apr. 2, 1993

[30] Foreign Application Priority Data

Apr. 2, 1992 [JP] Japan ..... 4-108440

[51] Int. Cl.[5] ..... B63H 21/38

[52] U.S. Cl. ..... 440/88; 114/183 R

[58] Field of Search ..... 440/38, 39, 40–43, 440/88, 89; 114/270, 183 R

[56] References Cited

U.S. PATENT DOCUMENTS

| | | | |
|---|---|---|---|
| 3,889,623 | 6/1975 | Arnold | 440/39 |
| 3,946,694 | 3/1976 | Belsky | 440/88 |
| 4,693,690 | 9/1987 | Henderson | 440/88 |
| 4,850,908 | 7/1989 | Nakase et al. | 440/39 |

FOREIGN PATENT DOCUMENTS 63-159613 2/1988 Japan .

*Primary Examiner*—Jesus D. Sotelo

*Attorney, Agent, or Firm*—Knobbe, Martens, Olson & Bear

[57] ABSTRACT

A number of embodiments of cooling systems for marine propulsion units having water cooled internal combustion engines in which the cooling jacket of the engine is at least partially positioned below the level of the water in which the watercraft is operating. The described embodiments all permit draining of the engine cooling jacket when it is not being run. In some embodiments, the drain valve also controls the communication of the coolant from the body of water in which the watercraft is operating with the engine cooling jacket. Various types of pumping arrangements are disclosed for pumping the bilge and automatic valve operation is also disclosed.

12 Claims, 6 Drawing Sheets

COOLING SYSTEM FOR MARINE PROPULSION ENGINE

BACKGROUND OF THE INVENTION

This invention relates to a cooling system for a marine propulsion engine and more particularly to an improved arrangement for precluding corrosion or contamination of the cooling system during periods when the watercraft is not in use.

As is well known, many forms of marine propulsion units employ internal combustion engines having liquid cooling jackets through which coolant from the body of water in which the watercraft is operating is circulated. Many times, as with inboard/outboard drives, the engine and its cooling jacket are disposed in the hull of the watercraft at a level below the water level, even when the watercraft is stationery. As a result of this, when the engine is not operating, coolant can flow by gravity into the cooling jacket or, alternatively, will be retained in the cooling jacket. This can present some problems, particularly when operating in marine environments wherein the coolant may comprise salt water. The retention of salt water in the engine cooling jacket can give rise to corrosion and other problems with respect to encrustation and the like.

Although arrangements have been provided for pumping water out of the bilge or other areas associated with the engine when not in use, the previously proposed systems have not provided any arrangement wherein the cooling jacket itself may be emptied of coolant. Hence, the problems aforenoted will exist.

It is, therefore, a principal object of this invention to provide an improved cooling system for a marine propulsion engine wherein the engine cooling jacket may be drained during periods of non-use.

It is a further object of this invention to provide an improved arrangement for the cooling jacket of an inboard engine wherein the cooling jacket may be completely drained when the boat is in a period of non-use.

SUMMARY OF THE INVENTION

This invention is adapted to be embodied in a watercraft having a hull in which an internal combustion engine is supported. The engine has a cooling jacket that is positioned at least in part below the level of water in which the hull is floating at least when the hull is stationery. Conduit means supply water from the body of water in which the watercraft is operating to the engine cooling jacket for cooling the engine. Valve means are provided for draining the cooling jacket during periods of non-use.

DETAILED DESCRIPTION OF THE PREFERRED EMBODIMENTS OF THE INVENTION

Figure 1:
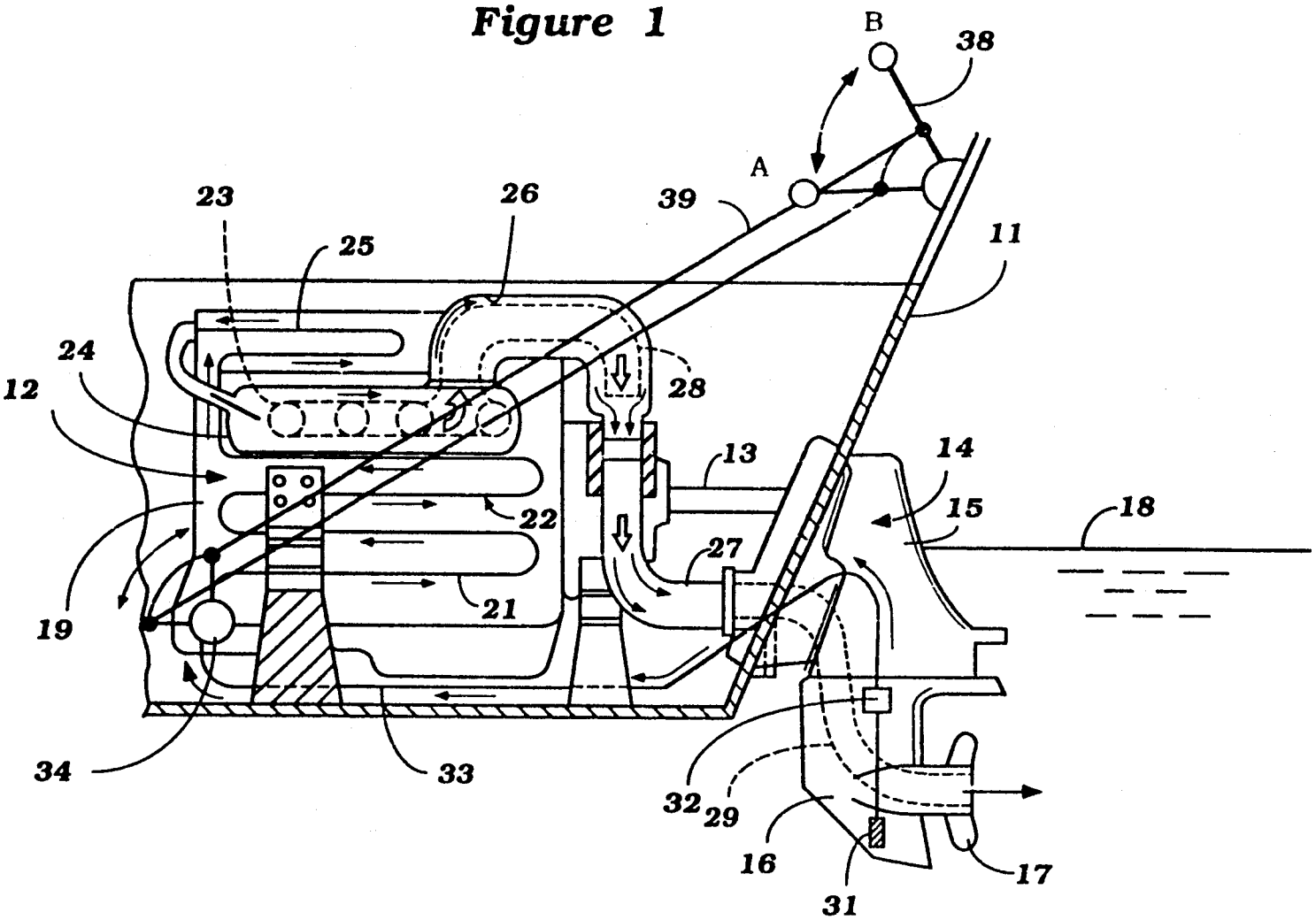
FIG. 1 is a side elevational view of a watercraft powered by an internal combustion engine constructed in accordance with a first embodiment of the invention, with portions broken away and other portions shown schematically.
Figure 2:
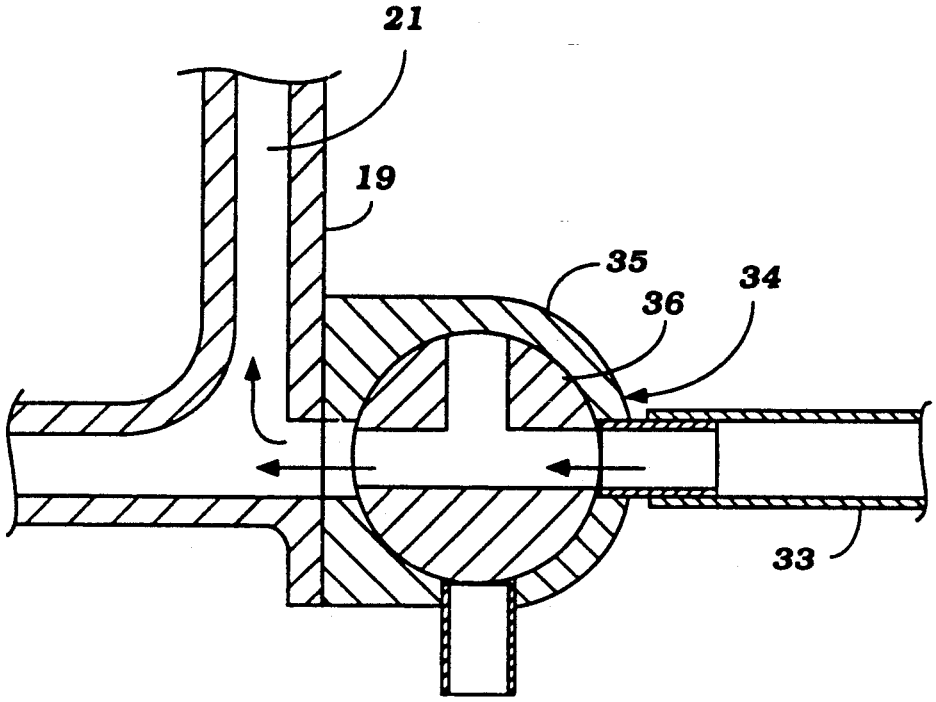
FIG. 2 is an enlarged cross sectional view of the coolant control valve for this embodiment showing the valve in the normal operating condition.
Figure 3:
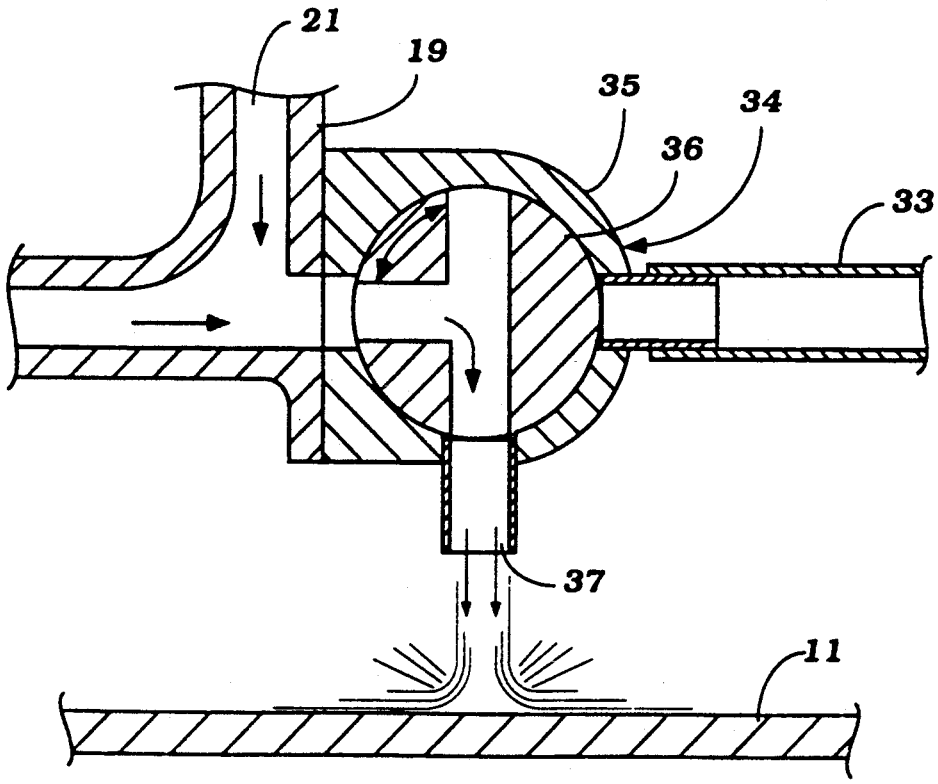
FIG. 3 is a cross sectional view, in part similar to FIG. 2, and shows the valve in the storage condition.

Referring now in detail to the drawings and initially to the embodiment of FIGS. 1 through 3 and initially primarily to FIG. 1, a watercraft powered by a marine propulsion unit constructed in accordance with an embodiment of the invention is shown partially and in cross section and is identified generally by the reference numeral 11. The watercraft 11 is powered by an inboard/outboard drive arrangement comprised of an internal combustion engine 12 which is mounted in the hull 11 forwardly of the transom in a suitable manner. The engine 12 drives a driveshaft 13 which extends through the transom of the watercraft 11 and which drives an outboard propulsion unit 14. The outboard propulsion unit 14 includes a housing assembly 15 that is supported on the transom for tilt and trim movement and steering movement in a well known manner. Since this portion of the construction forms no part of the invention, a detailed description of it is not believed to be necessary. However, the outboard drive housing assembly 15 includes a lower unit 16 in which a propeller 17 is supported for rotation and which is driven by the engine driveshaft 13 in a well known manner.

The engine 12 may be of any known type but in accordance with an important feature of the invention is water cooled and is cooled by drawing water from the body of water in which the watercraft is operated, the water level at rest being indicated by the line 18 in FIG. 1. The engine 12 may have an internal construction of any known type but includes a cylinder block 19. In addition, a cylinder head is affixed to the cylinder block 19. The cylinder head and cylinder block house a cooling jacket 22 indicated schematically and which includes a lower portion 21.

The cylinder head has a plurality of exhaust ports 23 which discharge the exhaust gases from the engine into an exhaust manifold 24. As is typical with outboard motor practice, there is provided a further cooling jacket 25 that encircles the exhaust manifold 24 and thus serves to cool it. An exhaust elbow 26 extends from the exhaust manifold 24 to a "Y" pipe 27 formed at the lower end of the outboard drive unit 14 but internally of the hull 11. The exhaust elbow 26 has a cooling jacket 28 through which the coolant is circulated from the engine and which is then mixed with the exhaust gases at "Y" pipe 27. This coolant and the exhaust gases are then discharged through a below the water through the hub exhaust gas discharge 29 formed in the lower unit 16 and propeller 17 of the outboard drive 14.

Coolant for the engine cooling jackets 21, 22, 25 and 26 is supplied from an underwater coolant inlet 31 formed at the lower portion of the lower unit 16 of the outboard drive portion 14. A coolant pump 32 is supported within the lower unit 16 and is driven by a drive-shaft for circulating the coolant through the cooling jackets in the direction indicated by the arrows in the figures. This coolant system includes a conduit 33 which serves the lower portion 21 of the cooling jacket 22.

It should be noted that the engine 12 and large portions of its cooling jackets, particularly the lower portion 21 is disposed below the water level 18. Hence, when the engine is not running, coolant will be retained in at least the portion 21 of the cooling jacket of the engine 12 and this can give rise to possible corrosion and other encrustation problems. To avoid this problem, there is provided a combined drain and supply valve 34 at the end of the conduit 33 and which controls the flow of water to and from the engine cooling jackets, in a manner which will be described by reference to FIGS. 2 and 3.

As shown in these figures, the control valve 34 is a three port two position valve plug type valve having a housing 35 in which a plug type valve element 36 is positioned. The valve element 36 has a "T" shaped internal passageway as best shown in FIGS. 2 and 3. In the position shown in FIG. 2, the plug type valve element 36 permits flow from the conduit 33 to the engine cooling jackets beginning with the cooling jacket 21. This is the normal position when the engine is operating.

However, during periods of inactivity, the valve 34 is shifted to the position shown in FIG. 3 wherein the engine cooling jackets communicate with a drain passage 37 formed integrally in the valve assembly 34 which dumps the water into the bilge of the hull 11. This water may be disposed of in a manner as will be described. Hence, when the watercraft is stationery, the engine cooling jacket may be completely drained even though it is below the body of water in which the watercraft is operating. Also, the valve 34 precludes any additional flow of coolant to the engine during the storage mode.

A remote operator consisting of a control lever 38 may be mounted on the transom of the watercraft and connected to the valve element 36 through a flexible transmitter 39 so that the valve 34 may be moved between the positions of FIGS. 2 and 3 as shown by the respective positions "B" and "A" in FIG. 1 so as to facilitate draining of the coolant. In addition, the valve operator 38 will be positioned in a location where the watercraft operator will readily see that the valve is in its drain or operative position and no likelihood of damage will result.

Figure 4:
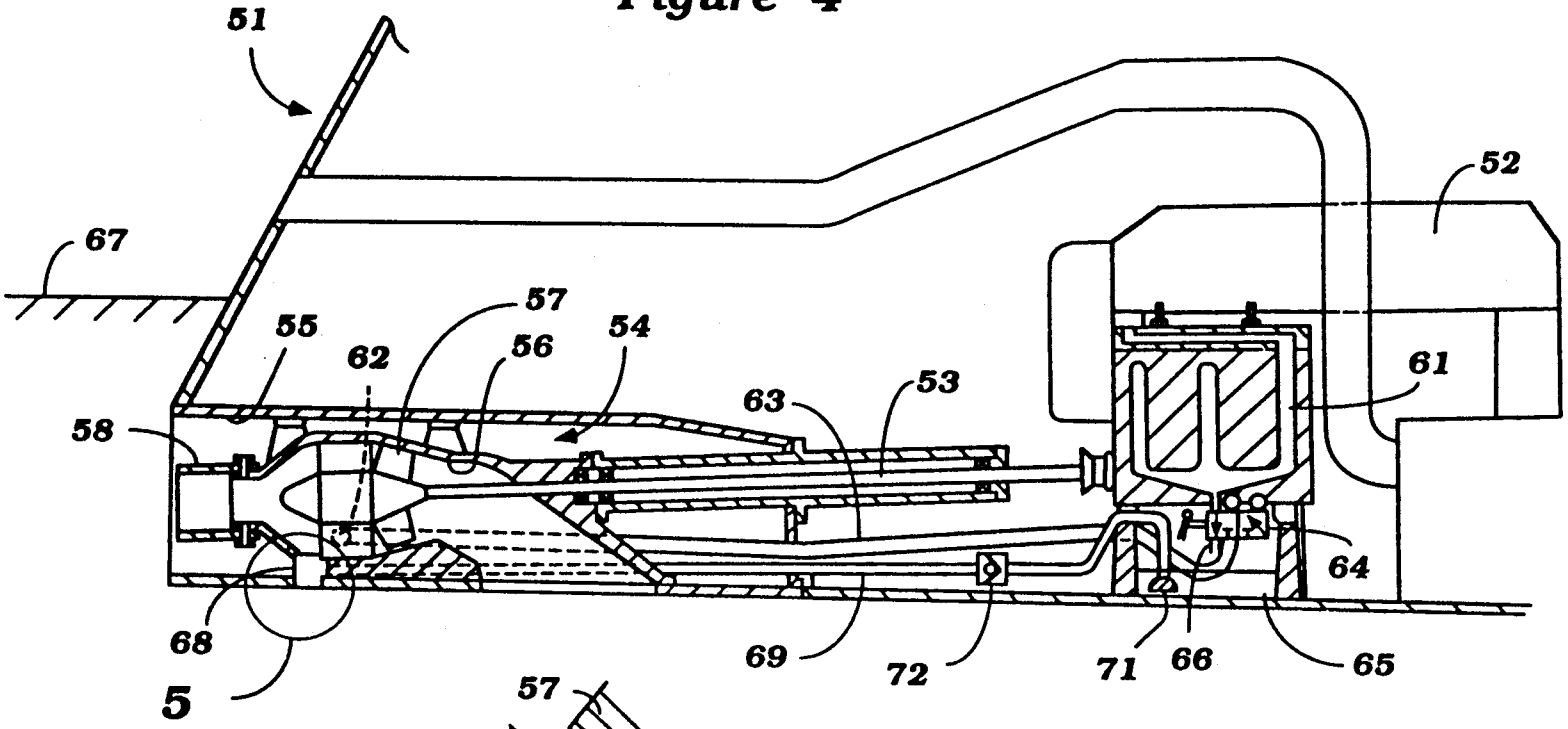
FIG. 4 is a partial cross sectional view of a watercraft constructed in accordance with another embodiment of the invention.
Figure 5:
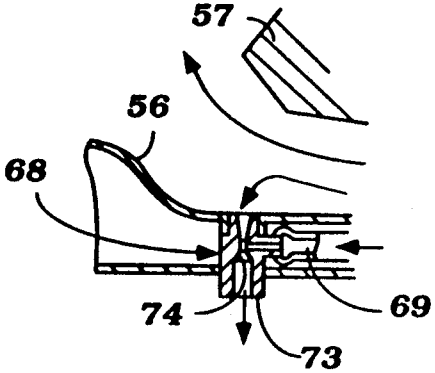
FIG. 5 is an enlarged cross sectional view of the area shown in the circle 5 in FIG. 4.

FIGS. 4 and 5 show another type of watercraft constructed in accordance with an embodiment of the invention, which watercraft is shown partially and is identified generally by the reference numeral 51. The watercraft 51 is of the type powered by an inboard drive and jet propulsion unit which consists of an inboard mounted internal combustion engine 52 which may have any desired type of construction but which, in accordance with a feature of the invention, is water cooled.

The engine 52 has its output shaft coupled to an impeller shaft 53 of a jet propulsion unit, indicated generally by the reference numeral 54 and which is positioned within a tunnel 55 formed to the rear of the hull of the watercraft 51. The jet propulsion unit 54 has a downwardly facing water inlet opening 56 through which water is drawn by the operation of an impeller 57 which is coupled to the impeller shaft 53. This water is then discharged through a pivotally supported steering nozzle 58 for providing a propulsion force for the watercraft. The construction and operation of the jet propulsion unit 54 may be considered to be conventional, except as will be hereinafter noted, and for that reason further details of its construction is not believed to be necessary to understand the construction and operation of this embodiment.

As has been previously noted, the engine 52 is water cooled and to this end it is provided with a cooling jacket, shown partially and identified by the reference numeral 61. As with the previously described types of constructions, the cooling jacket 61 may be formed as a cylinder block, cylinder head and exhaust manifold cooling jacket and any desired pattern of circulation may take place therethrough. Under normal operation, coolant is delivered to the engine cooling jacket 61 from a pressure port 62 formed downstream of the impeller portion 57 of the jet propulsion unit 54 and which supplies coolant to a conduit 63 under pressure. The conduit 63 feeds a control and drain valve 64 which is comprised of a two position, two way valve which in one position (that not shown) coolant is delivered from the conduit 63 through the engine cooling jacket 61 for discharge in any suitable pattern. Normally, as it is typical with marine practice, the coolant from the engine cooling jacket can be delivered to the exhaust gases and discharged back to the body of water in which the watercraft is operating through the exhaust system.

The control and drain valve 64 is positioned above a bilge area 65 formed in the hull 51 adjacent the engine 52. When the watercraft is stationery, the control and drain valve 64 may be moved to the position shown in FIG. 4 wherein coolant can drain through a drain passage 66 from the engine cooling jacket 61 into the bilge area 65 for collection there. As with the previously described embodiment, it should be noted that the normal water level 67 when the watercraft 51 is stationery is above at least a portion of the engine cooling jacket 61.

A Venturi type pump assembly is provided for draining the bilge area 65 when the watercraft is again returned to operation and this Venturi pump is indicated generally by the reference numeral 68 and is shown in most detail in FIG. 5. A drain conduit 69 extends from a strainer 71 in the bilge area 65 to the Venturi pump 68. A one way check valve 72 permits flow from the bilge 65 to the Venturi pump 68 but precludes flow in the reverse direction. The Venturi pump 68 will receive a small amount of water under pressure from the operation of the impeller 57 as shown by the arrows in FIG. 5 and discharge it through a downwardly facing discharge opening 73. A Venturi section 74 is provided upstream thereof and the conduit 69 cooperates with this Venturi section. As a result, when the watercraft 51 is placed back in service and the jet propulsion unit 54 is operated, coolant which has been drained from the engine cooling jacket 61 through the drain control valve 64 into the bilge area 65 will be pumped back into the body of water in which the watercraft is operating so as to avoid too much water being accumulated in the bilge area 65.

Figure 6:
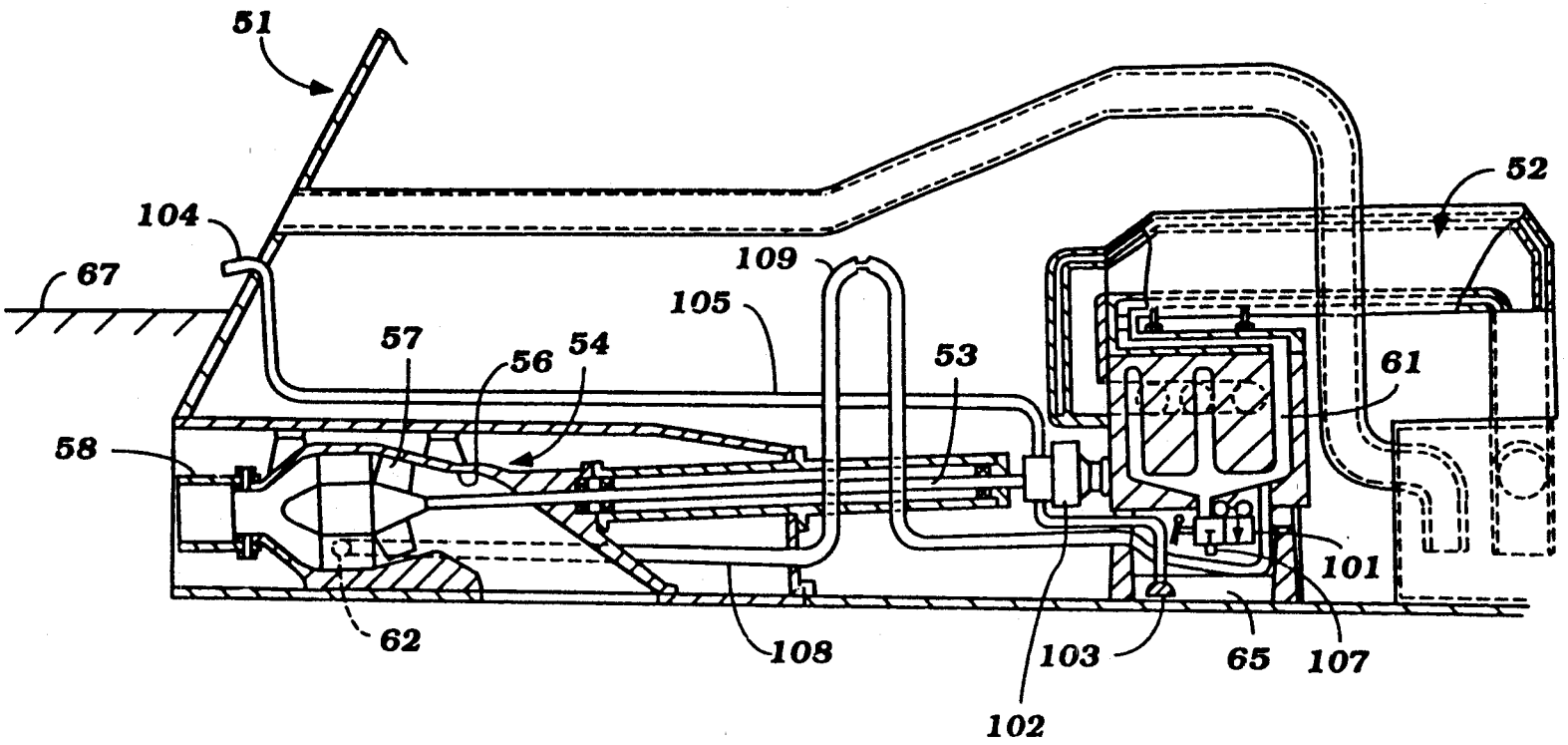
FIG. 6 is a cross sectional view, in part similar to FIGS. 1 and 4 and shows another embodiment of the invention.

FIG. 6 is another embodiment of the invention which is in part similar to the embodiment of FIGS. 4 and 5 and, for that reason, components of this embodiment which are the same as the previously described embodiment have been identified by the same reference numerals. This embodiment differs from the embodiment of FIGS. 4 and 5 in two regards. First, the drain and control valve of this embodiment, indicated by the reference numeral 101 actually only controls the opening of a drain passage from the engine cooling jacket 61 and does not control the flow of coolant from the body of water into the cooling jacket 61 as with the previously described embodiments. In addition, in this embodiment, a bilge pump 102 having a strainer inlet 103 is driven from the engine output or impeller shaft 53 and will pump water out of the bilge area 65 through a discharge port 104 formed in the rear portion of the hull 51. A discharge conduit 105 interconnects the pump 102 with the discharge outlet 104.

Since the valve 101, which has a drain 107 that communicates with the bilge area 65 does not control the flow of coolant from the body of water to the cooling jacket, an arrangement is provided for insuring that coolant cannot flow through the supply conduit to the cooling jacket 61 when the engine 52 is not being operated. This embodiment, also uses the pressure port 62 in the jet propulsion unit 54 for delivering coolant to the engine through a supply conduit 108. However, the supply conduit 108 has a trap portion 109 that extends above the water level 67 and thus will act as a dam to prevent coolant from flowing by gravity to the cooling jacket 61 at times when the watercraft is stationery. A small air bleed may be formed in the trap 109 so as to insure that the water will drain from the conduit 108 when the engine is not running and when the valves 101 is in its drained position. In all other regards, this embodiment is the same as those previously described and has the same advantages as those embodiments already described.

Figure 8:
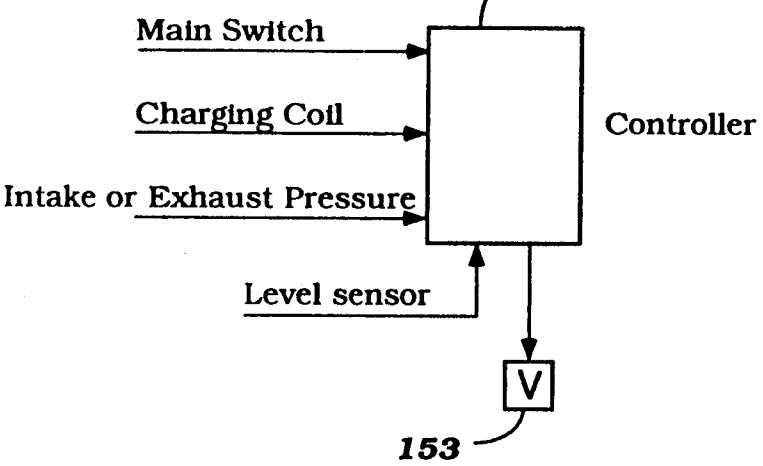
FIG. 8 is a partially schematic view showing the control arrangement for this embodiment of the invention.
Figure 7:
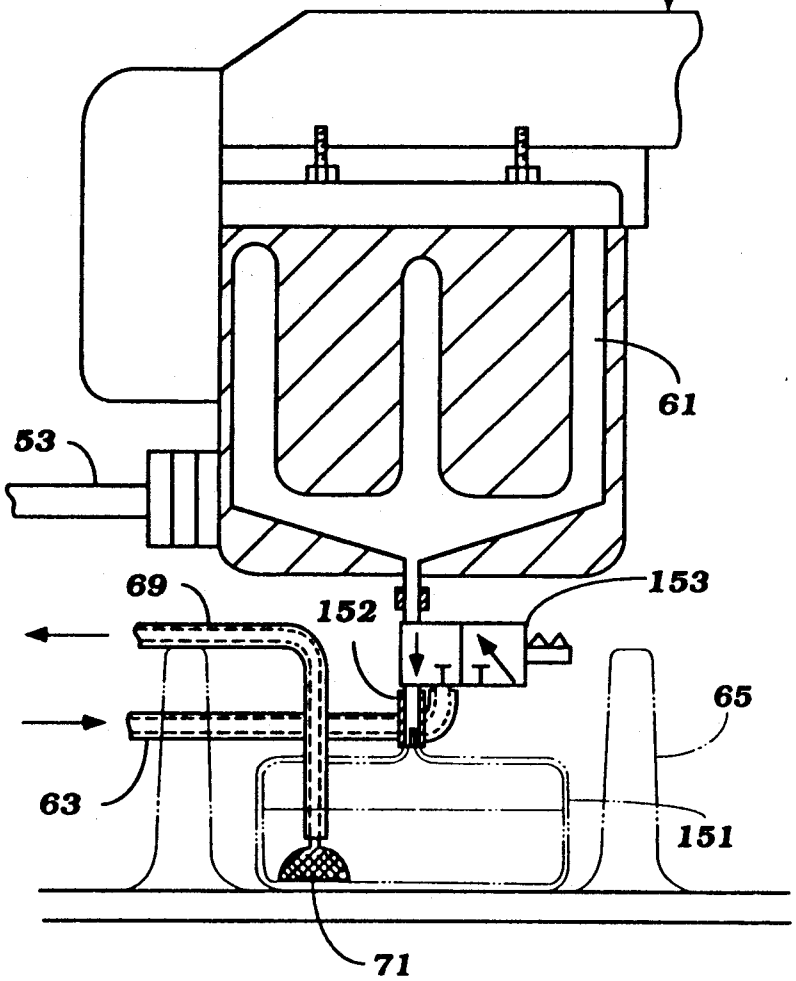
FIG. 7 is a partial cross sectional view taken through another embodiment of the invention.

FIGS. 7 and 8 show another embodiment of the invention wherein the control valve is operated automatically. This embodiment is generally similar to the embodiments of FIGS. 4 and 5 and FIG. 6 and, for that reason, components of this embodiment which are the same as those previously described have been identified by the same reference numerals and will be described again only insofar as is necessary to understand the construction and operation of this embodiment. In this embodiment, the bilge area 65 is provided with a catch tank 151 which communicates with the engine cooling jacket 61 through a drain 152 and which a combined control and drain valve 153 is positioned. The drain valve 153 is electrically operated and FIG. 8 is a schematic showing of the electrical system for operating the valve 153.

In this embodiment, it will be noted that the supply conduit 63 for the coolant serves the valve 153 and a drain conduit 69 in which a strainer 71 is positioned serves to drain the catch tank 151. The supply and drain systems of this embodiment may be the same as either the embodiment of FIGS. 4 and 5 or the embodiment of FIG. 6. Although the embodiment of FIGS. 4 and 5 is preferred since the trap of FIG. 6 is not required in this embodiment because the drain and control valve 153 is a two way two position valve that either connects the supply port 62 with the cooling jacket 61 or drains the cooling jacket 61 into the catch tank 151 through the drain passage 152.

As may be seen in FIG. 8, there is a valve controller, indicated generally by the reference numeral 154 which receives certain signals from various components including a source of electrical power from a main switch which indicates that the main switch is on and also which powers the controller 154. In addition, an output from the charging coil of the ignition circuit is supplied to the controller as well as a sensor which senses either intake or exhaust pressure which indicates that the engine is operating. In addition, a level sensor senses the level of liquid in either the bilge 65 or catch tank 151 so as to operate the valve to close the valve 153 in the event the bilge tank becomes completely filled. Normally, however, when the engine is not running an output is not sensed from the charging coil and/or intake or exhaust pressure sensors, the controller 154 will determine that the watercraft is in a storage condition and will open the valve 153 so as to drain the system of coolant.

Figure 9:
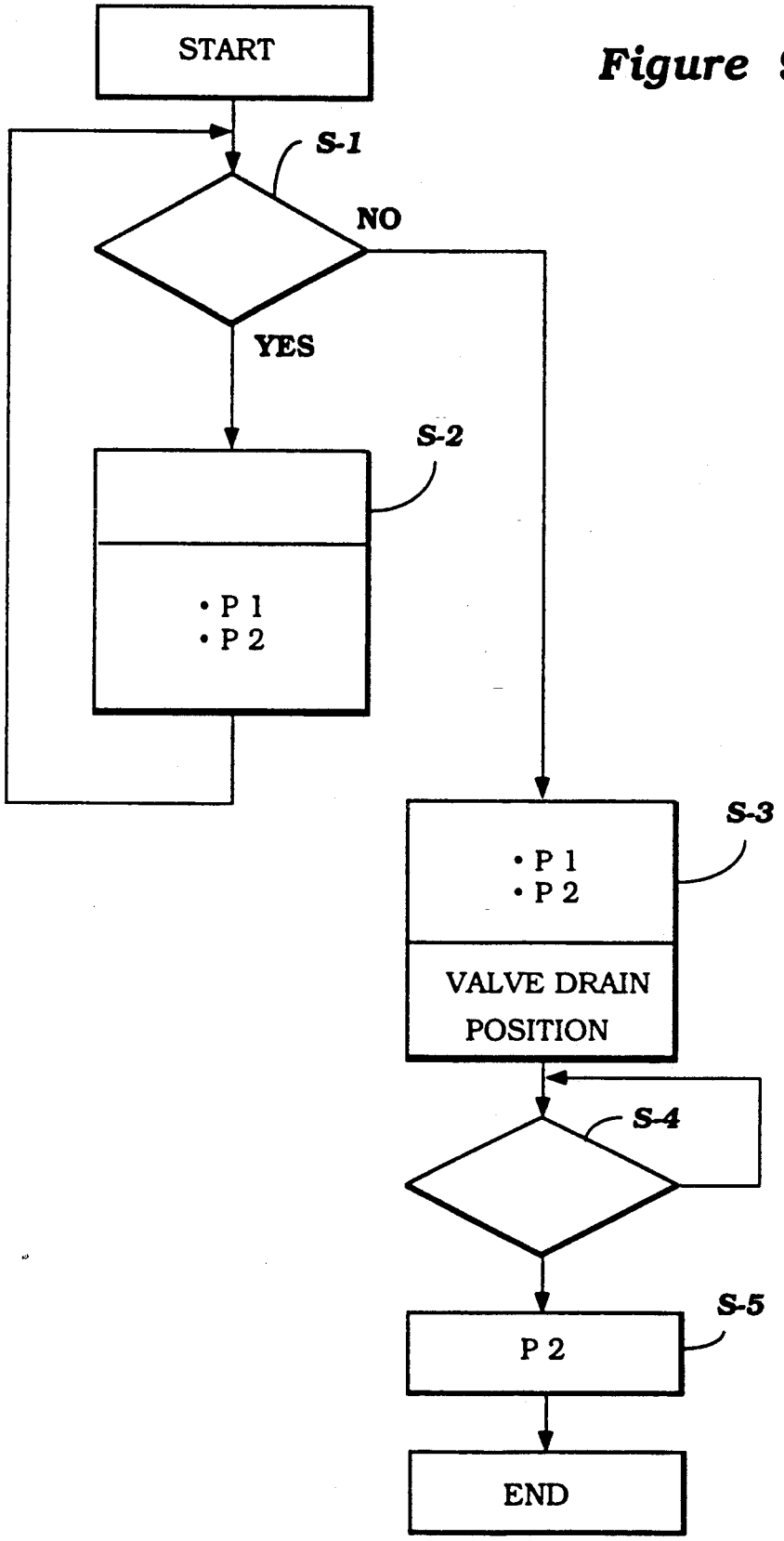
FIG. 9 is a block diagram showing another embodiment of the invention.

FIG. 9 shows another arrangement for providing automatic control in an arrangement wherein the system is provided with not only a drain valve as with all of the described embodiments except for FIG. 6 and also is provided with two pump drives P-1 and P-2, one of which circulates coolant to the engine cooling jacket and the other of which serves the purpose of pumping coolant from the bilge. In this embodiment, the program starts and then moves to a step S-1 to determine if the engine is being operated. If the engine is being operated, the program then moves to the water supply mode of step S-2 wherein both the supply pump P-1 and circulating pump P-2 are operated and the drain valve is positioned in its normal supply circulating mode. If, however, the engine is indicated as being stopped at the step S-1, the program then moves to the step S-3 so as to stop both the pumps P-1 and P-2. The control valve is then put in the drain position and this can be easily done with the electrical type of control valve as shown in FIG. 7. Once the valve is in the drain position, the program moves to the step S-4 so as to determine if there is sufficient coolant accumulated in the bilge 65 so as to require draining. Once there is, the program moves to the step S-5 so as to operate the drain pump P-2 and continue to operate it until the bilge is drained at which time the program is ended.

It should be readily apparent from the foregoing description that the described embodiments of the invention are extremely effective in providing good cooling for a marine propulsion unit wherein the engine has a cooling jacket that is disposed below the water level in which the watercraft is present but which will also drain the coolant from the engine when the watercraft is not being operated for a period of time so as to prevent corrosion and encrustation and other problems. It should be understood that the embodiments described are preferred embodiments of the invention and various changes and modifications may be made without departing from the spirit and scope of the invention, as defined by the appended claims.

We claim:

1. A watercraft having a hull, an internal combustion engine supported within said hull, said engine having a cooling jacket positioned at least in part below the level of water in which said hull is floating at least when said hull is stationary, conduit means for supplying water from the body of water in which said watercraft is operating to said engine cooling jacket for cooling said engine, and two position two way valve means for selectively communicating said cooling jacket to a drain for draining said cooling jacket and for selectively communicating said cooling jacket to said conduit means for delivering water to said cooling jacket.

2. A watercraft having a hull as set forth in claim 1 further including means for remotely operating the valve means.

3. A watercraft having a hull as set forth in claim 1 further including means for pumping coolant into the conduit means.

4. A watercraft having a hull as set forth in claim 3 further including means for remotely operating the valve means.

5. A watercraft having a hull as set forth in claim 1 wherein the valve means drains the cooling jacket into a bilge of the hull.

6. A watercraft having a hull as set forth in claim 5 further including pump means for pumping drained water from the bilge.

7. A watercraft having a hull as set forth in claim wherein the pump means is driven by the engine for pumping water from the bilge when the engine is again operated.

8. A watercraft having a hull as set forth in claim 7 wherein the engine drives a jet propulsion unit and wherein the jet propulsion unit supplies coolant under pressure to the engine.

9. A watercraft having a hull as set forth in claim 8 wherein the jet propulsion unit includes a Venturi pump for pumping coolant from the bilge.

10. A watercraft having a hull as set forth in claim 5 further including a catch tank contained within the bilge for receiving the drained coolant.

11. A watercraft having a hull an internal combustion engine supported within said hull, said engine having a cooling jacket positioned at least in part below the level of water in which said hull is floating at least when said hull is stationary, conduit means for supplying water from the body of water in which said watercraft is operating to said engine cooling jacket for cooling said engine, valve means for selectively communicating said cooling jacket to a drain for draining said cooling jacket, and means for automatically moving said valve means to its drain position when said engine is not being operated.

12. A watercraft having a hull as set forth in claim 11 wherein the valve means further controls the communication of the cooling jacket with the conduit means and comprises a two position two way valve.

* * * * *